US008944751B2

(12) United States Patent
Winn et al.

(10) Patent No.: US 8,944,751 B2
(45) Date of Patent: Feb. 3, 2015

(54) TURBINE NOZZLE COOLING ASSEMBLY

(75) Inventors: Aaron Gregory Winn, Piedmont, SC (US); Robert Walter Coign, Piedmont, SC (US); James Stewart Phillips, Easley, SC (US); Thomas Robbins Tipton, Greer, SC (US); Gregory Thomas Foster, Greer, SC (US); Ravichandran Meenakshisundaram, Greenville, SC (US); Niranjan Gokuldas Pai, Clifton Park, SC (US)

(73) Assignee: General Electric Company, Schenectady, NY (US)

( * ) Notice: Subject to any disclaimer, the term of this patent is extended or adjusted under 35 U.S.C. 154(b) by 563 days.

(21) Appl. No.: 13/345,776

(22) Filed: Jan. 9, 2012

(65) Prior Publication Data

US 2013/0175357 A1 Jul. 11, 2013

(51) Int. Cl.

| | |
|---|---|
| ***B05B 9/00*** | (2006.01) |
| ***F01D 11/00*** | (2006.01) |
| *B05B 1/00* | (2006.01) |

(52) U.S. Cl.

CPC ..... *F01D 11/001* (2013.01); *F05D 2240/128* (2013.01)

USPC ..... 415/116; 415/115; 416/96 R

(58) Field of Classification Search

CPC ..... F01D 9/02; F01D 9/023; F01D 11/001; F01D 11/005; F01D 11/025; F01D 11/12; F05D 2240/128; F05D 2240/81; F05D 2260/201

USPC ..... 415/115, 116, 139, 173.7, 174.4, 174.5, 415/202; 416/96 R, 96 A, 193 A

See application file for complete search history.

(56) References Cited

U.S. PATENT DOCUMENTS

| | | | | |
|---|---|---|---|---|
| 4,187,054 | A | 2/1980 | Landis, Jr. et al. | |
| 5,197,852 | A | 3/1993 | Walker et al. | |
| 5,609,466 | A | 3/1997 | North et al. | |
| 5,746,573 | A * | 5/1998 | Junkin et al. | 415/115 |
| 6,065,928 | A * | 5/2000 | Rieck et al. | 415/115 |
| 6,227,798 | B1 | 5/2001 | Demers et al. | |
| 6,382,906 | B1 | 5/2002 | Brassfield et al. | |
| 6,383,602 | B1 | 5/2002 | Fric et al. | |
| 6,386,825 | B1 | 5/2002 | Burdgick | |
| 6,418,618 | B1 | 7/2002 | Burdgick | |
| 6,508,620 | B2 * | 1/2003 | Sreekanth et al. | 415/115 |
| 6,761,529 | B2 | 7/2004 | Soechting et al. | |

(Continued)

FOREIGN PATENT DOCUMENTS

| | | | |
|---|---|---|---|
| EP | 0911486 | A2 | 4/1999 |
| EP | 0940562 | A2 | 9/1999 |
| WO | 02092970 | A1 | 11/2002 |

OTHER PUBLICATIONS

Search Report and Written Opinion from EP Application No. 13150161.1 dated Mar. 25, 2013.

*Primary Examiner* — Dwayne J White
*Assistant Examiner* — Alexander White
(74) *Attorney, Agent, or Firm* — Sutherland Asbill & Brennan LLP

(57) ABSTRACT

The present application provides an inner nozzle platform. The inner nozzle platform may include a platform cavity, an impingement plenum positioned within the platform cavity, a retention plate positioned on a first side of the impingement plenum, and a compliant seal positioned on a second side of the impingement plenum.

18 Claims, 2 Drawing Sheets

(56) References Cited

U.S. PATENT DOCUMENTS

| | | | | |
|---|---|---|---|---|
| 6,769,865 | B2 | 8/2004 | Kress et al. | |
| 6,932,568 | B2 | 8/2005 | Powis et al. | |
| 6,984,101 | B2 | 1/2006 | Schiavo, Jr. | |
| 7,029,228 | B2 | 4/2006 | Chan et al. | |
| 7,252,481 | B2 | 8/2007 | Stone | |
| RE40,658 | E | 3/2009 | Powis et al. | |
| 7,575,416 | B2 * | 8/2009 | Funk et al. | 416/193 A |
| 2002/0028134 | A1 | 3/2002 | Burdgick | |
| 2002/0182057 | A1 | 12/2002 | Liotta et al. | |
| 2002/0187040 | A1 | 12/2002 | Predmore | |
| 2005/0169746 | A1 * | 8/2005 | Fuller et al. | 415/115 |
| 2005/0244267 | A1 | 11/2005 | Coign et al. | |
| 2006/0053798 | A1 | 3/2006 | Hadder | |
| 2006/0062673 | A1 | 3/2006 | Coign et al. | |
| 2006/0073011 | A1 | 4/2006 | Lee et al. | |
| 2007/0237624 | A1 | 10/2007 | Nigmatulin | |
| 2008/0089780 | A1 | 4/2008 | Erickson et al. | |
| 2008/0152488 | A1 | 6/2008 | Kammel et al. | |
| 2009/0185896 | A1 * | 7/2009 | Kizuka et al. | 415/115 |
| 2010/0011773 | A1 | 1/2010 | Suleiman et al. | |
| 2010/0068041 | A1 | 3/2010 | Nigmatulin et al. | |
| 2010/0278631 | A1 | 11/2010 | Heda et al. | |
| 2010/0281879 | A1 | 11/2010 | Shapiro et al. | |
| 2010/0284800 | A1 | 11/2010 | Sewall et al. | |
| 2011/0014045 | A1 | 1/2011 | McCall | |
| 2011/0014054 | A1 | 1/2011 | Nagler et al. | |
| 2011/0044803 | A1 | 2/2011 | DiPaola et al. | |
| 2011/0189000 | A1 | 8/2011 | Vedhagiri et al. | |

* cited by examiner

TURBINE NOZZLE COOLING ASSEMBLY

TECHNICAL FIELD

The present application and the resultant patent relate generally to gas turbine engines and more particularly relate to a cooling assembly for an inner platform of a cantilevered turbine nozzle and the like.

BACKGROUND OF THE INVENTION

Impingement cooling systems have been used with turbine machinery to cool various types of components such as casings, buckets, nozzles, and the like. Impingement cooling systems cool the components via an airflow so as to maintain adequate clearances between the components and to promote adequate component lifetime. One issue with some types of known impingement cooling systems, however, is that they tend to require complicated castings and/or structural welding. Such structures may have low durability or may be expensive to produce and repair.

There is thus a desire for a producible cooling assembly for use with turbine nozzles. Preferably, such a producible cooling assembly can adequately face high gas path temperatures while meeting lifetime and maintenance requirements as well as being reasonable in cost.

SUMMARY OF THE INVENTION

The present application and the resultant patent thus provide an inner nozzle platform. The inner platform may include a platform cavity, an impingement plenum positioned within the platform cavity, a retention plate positioned on a first side of the impingement plenum, and a compliant seal positioned on a second side of the impingement plenum.

The present application and the resultant patent further provide a nozzle vane. The nozzle vane may include an inner platform and an impingement cooling assembly positioned within the inner platform. A retention plate may be positioned on a first side of the impingement cooling assembly and a compliant seal may be positioned on a second side of the impingement cooling assembly.

The present application and the resultant patent further provide a nozzle vane. The nozzle vane may include an inner platform and an impingement cooling assembly positioned within the inner platform. A seal carrier may be positioned on a first side of the impingement cooling assembly and a compliant seal gasket may be positioned on a second side of the impingement cooling assembly.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
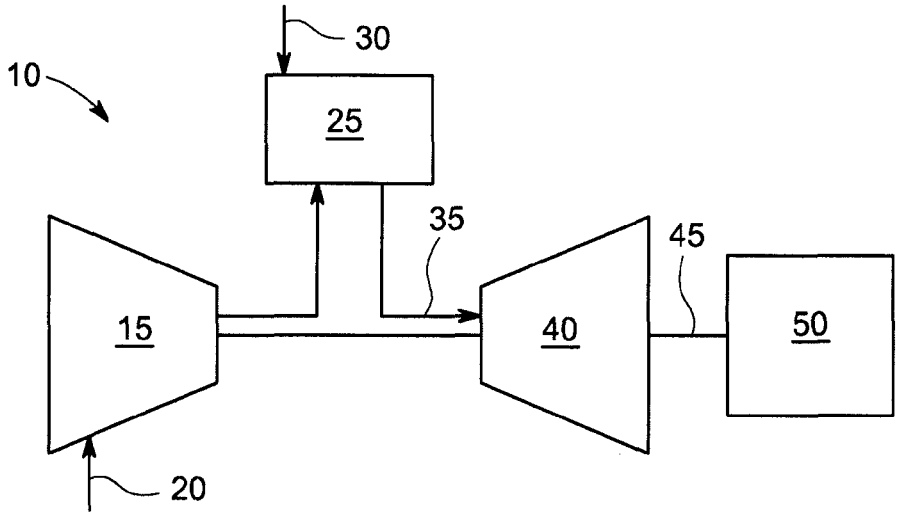
FIG. 1 is a schematic diagram of a gas turbine engine showing a compressor, combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
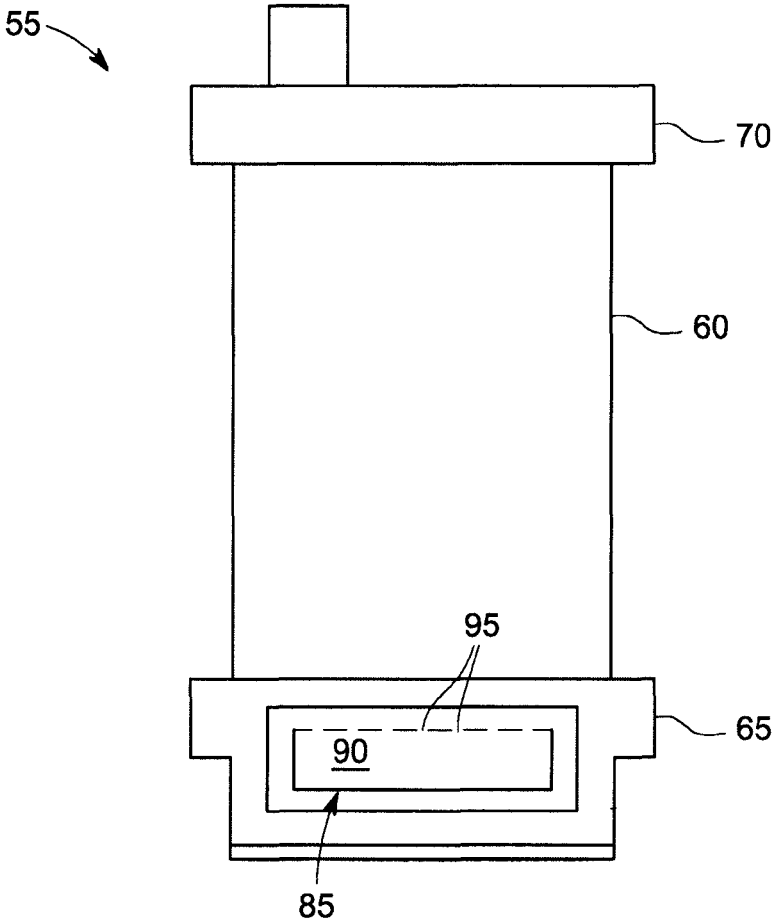
FIG. 2 is a partial side view of a nozzle vane with an impingement cooling assembly therein.

FIG. 2 is an example of a nozzle 55 that may be used with the turbine 40 described above. Generally described, the nozzle 55 may include a nozzle vane 60 that extends between an inner platform 65 and an outer platform 70. A number of the nozzles 55 may be combined into a circumferential array to form a stage with a number of rotor blades (not shown).

The nozzle 55 also may include an impingement cooling assembly 85 with an impingement plenum 90. The impingement plenum 90 may have a number of impingement apertures 95 formed therein. The impingement plenum 90 may be in communication with the flow of air 20 from the compressor 15 or another source via a spoolie or other type of cooling conduit. The flow of air 20 extends through the nozzle vane 60, into the impingement cooling assembly 85, and out via the impingement apertures 95 so as to impingement cool a portion of the nozzle 55 or elsewhere. Other components and other configurations may be used herein.

Figure 3:
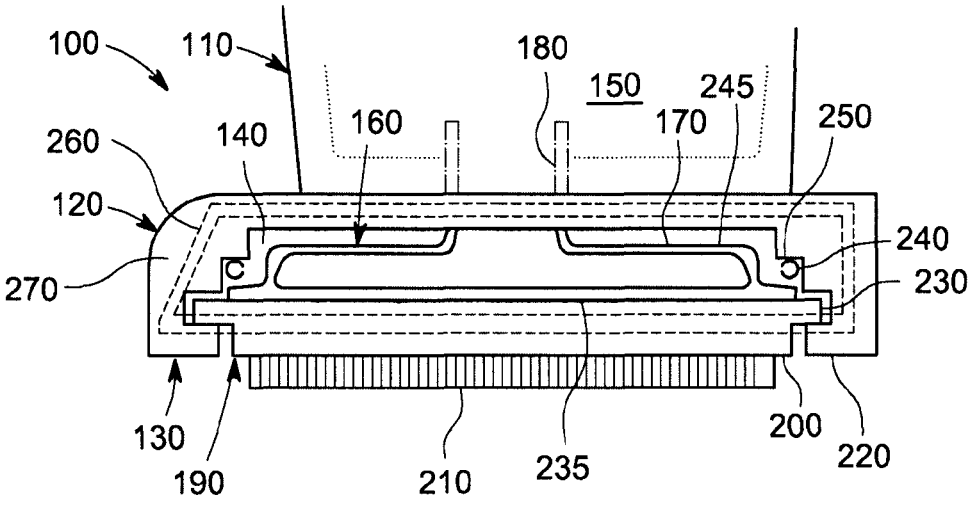
FIG. 3 is a partial side view of an example of a nozzle vane with an impingement cooling assembly as may be described herein.

FIG. 3 shows portions of an example of a nozzle 100 as may be described herein. In addition to other components, the nozzle 100 includes a vane 110 extending from platform 120. The platform 120 may include a platform cavity 140. The vane 110 may include an airflow cavity 150 therein. The airflow cavity 150 may be in communication with the platform cavity 140 so as to provide the flow of air 20 from the compressor 15 or elsewhere. The nozzle 100 also may include an impingement cooling assembly 160. The impingement cooling assembly 160 may include an impingement plenum 170. The impingement plenum 170 may include a spoolie or other type of cooling conduit 180 in communication with the flow of air 20 from the airflow cavity 150. Other components and other configurations also may be used herein.

The impingement plenum 170 may be positioned and retained within the platform cavity 140. The impingement plenum 170 may be retained within the platform cavity 140 on one side via a retention plate 190. The retention plate 190 may be a substantially flat plate and the like. Alternatively, the retention plate 190 may be in the form of a seal carrier 200 as is shown. The seal carrier 200 may have a number of seals 210 thereon. The retention plate 190 and the seal carrier 200 may have any size, shape, or configuration. The retention plate 190 also may take the form of a number of welded tabs, a welded ring, and the like. Any type of mechanical retention features may be used herein.

Figure 4:
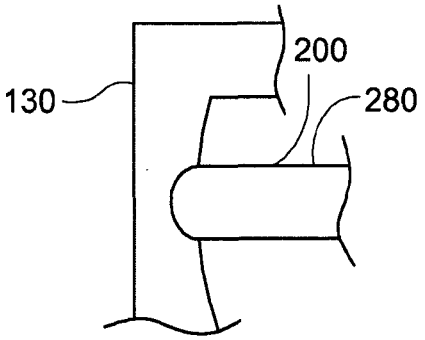
FIG. 4 is a partial side view of an example of a retention plate positioned within a platform cavity.
Figure 5:
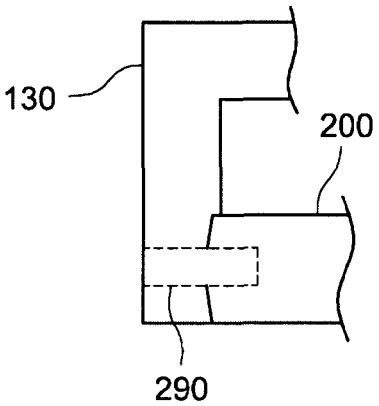
FIG. 5 is a partial side view of a further example of a retention plate positioned within a platform cavity.

The retention plate 190, the seal carrier 200, and the like may be retained within the platform cavity 140 via one or more platform hooks 220 and/or plate hooks 230. The retention plate 190 may be positioned on a first side 235 of the impingement plenum 170. The platform hooks 220 and the plate hooks 230 may take any configuration of male and female members in any orientation. One or more of the hooks 220, 230 may be angled so as to allow for tool clearances for machining and the like. As is shown in FIG. 4, either of the hooks 220, 230 also may take a largely cylindrical or elliptical protrusion or contour 280. Furthermore as is shown in FIG. 5, one or more pins 290 and the like also may be used as a retention feature. The hooks 220, 230, the cylindrical contour 280, the pins 290, and other structures may be used in any combination to retain the retention plate 190 within the platform cavity 140, i.e., combinations of hooks 220, 230 and pins 290 may be used together in any orientation. Other types of attachment means and features also may be used herein.

Referring again to FIG. 3, the impingement cooling assembly 160 also may use a compliant seal gasket 240 about a second side 245 of the impingement plenum 170 and the platform cavity 140. The compliant seal gasket 240 may extend around the perimeter of the impingement plenum 170. A retention shelf 250 also may be used adjacent to the compliant seal gasket 240. The impingement plenum 170 thus largely floats about the compliant seal gasket 240. Given such, the use of welding and the like may be avoided herein. Other types of seals also may be used herein about the second side 245 of the impingement plenum 170. Other types of attachment means and features also may be used herein.

One or more seals 260 also may be positioned about the slash face 270 of the platform 120. The seals 260 may be in the form of a number of spline seals and the like. Other types of seals may be used herein. A number of the seals 260 may be retained by the retention plate 190, the seal carrier 200, or other structures so as to allow tight radial packing. The seals 260 may form a plenum that is pressurized with a post-impingement flow routed from the platform cavity 140. Other components and other configurations may be used herein.

The nozzle 100 described herein thus may maintain the impingement cooling assembly 160 nested therein between the mechanical retention of the retention plate 190 on one side and the compliant seal gasket 240 on the other. The impingement cooling assembly 160 thus provides effective cooling about the nozzle 100 without the use of welding or complex sidewall cores in a minimal radial space. Non-weldable materials thus may be used herein. The impingement cooling assembly 160 permits the nozzle 100 to face the high gas path temperatures while meeting lifetime and maintenance requirements in a producible design. Retaining the impingement cooling assembly 160 with the seal carrier 200 also permits a minimal radial envelope.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A nozzle inner platform, comprising:

a platform cavity comprising hooks on opposite sides of the platform cavity;

an impingement plenum positioned within the platform cavity;

a retention plate coupled within the platform cavity and positioned on a first side of the impingement plenum, the retention plate secured in the platform cavity by engaging the hooks on opposite sides of the platform cavity; and a compliant seal positioned on a second side of the impingement plenum.

2. The nozzle inner platform of claim 1, wherein the retention plate comprises a seal carrier.

3. The nozzle inner platform of claim 1, wherein the retention plate comprises a cylindrical contour such that the retention plate is retained in the platform cavity.

4. The nozzle inner platform of claim 1, further comprising one or more pins extending into the platform cavity such that the retention plate is retained in the platform cavity.

5. The nozzle inner platform of claim 1, wherein the compliant seal comprises a compliant seal gasket.

6. The nozzle inner platform of claim 1, wherein the platform cavity comprises a retention shelf positioned about the compliant seal.

7. The nozzle inner platform of claim 1, further comprising a slash face and wherein the slash face comprises a seal or a plurality of seals thereon.

8. The nozzle inner platform of claim 1, wherein the impingement plenum comprises a cooling conduit in communication with a flow of air.

9. The nozzle inner platform of claim 1, wherein the impingement plenum comprises a plurality of apertures positioned about a nozzle platform.

10. The nozzle inner platform of claim 1, wherein the retention plate is surrounded by the platform cavity.

11. A nozzle vane, comprising:

an inner platform comprising a platform cavity;

an impingement cooling assembly positioned within the platform cavity of the inner platform;

a retention plate positioned on a first side of the impingement cooling assembly; and a compliant seal positioned on a second side of the impingement cooling assembly;

wherein the retention plate comprises a cylindrical contour such that the retention plate is retained in and surrounded by the platform cavity.

12. The nozzle vane of claim 11, wherein the impingement cooling assembly comprises an impingement plenum and a cooling conduit.

13. The nozzle vane of claim 11, wherein the retention plate comprises a seal carrier.

14. The nozzle vane of claim 11, wherein the platform cavity comprises one or more platform hooks and the retention plate comprises one or more plate hooks such that the retention plate is retained in the platform cavity.

15. The nozzle vane of claim 11, further comprising one or more pins extending into the platform cavity such that the retention plate is retained in the platform cavity.

16. A nozzle vane, comprising:

an inner platform comprising a platform cavity with hooks on opposite sides of the platform cavity;

an impingement cooling assembly positioned within the inner platform;

a seal carrier positioned on a first side of the impingement cooling assembly, the seal carrier coupled within and surrounded by the platform cavity; and a compliant seal gasket positioned on a second side of the impingement cooling assembly.

17. The nozzle vane of claim 16, wherein the inner platform comprises a slash face and wherein the slash face comprises a plurality of seals thereon.

18. The nozzle vane of claim 17, wherein the slash face comprises a pressure cavity created by the plurality of seals and fed from the impingement cooling assembly.

* * * * *